US007213910B2

(12) United States Patent
Chikamoto

(10) Patent No.: US 7,213,910 B2
(45) Date of Patent: May 8, 2007

(54) INK-JET HEAD

(75) Inventor: Tadanobu Chikamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 141 days.

(21) Appl. No.: 10/879,118

(22) Filed: Jun. 30, 2004

(65) Prior Publication Data

US 2005/0057612 A1 Mar. 17, 2005

(30) Foreign Application Priority Data

Jun. 30, 2003 (JP) ..... 2003-189000

(51) Int. Cl.
*B41J 2/045* (2006.01)

(52) U.S. Cl. ..... 347/68; 347/71; 347/72

(58) Field of Classification Search ..... 347/68–72
See application file for complete search history.

(56) References Cited

U.S. PATENT DOCUMENTS 6,969,158 B2 11/2005 Taira
2002/0018095 A1* 2/2002 Nakamura et al. ..... 347/40
2002/0036678 A1 3/2002 Ito et al.
2003/0067511 A1 4/2003 Okazawa

FOREIGN PATENT DOCUMENTS

| | | |
|---|---|---|
| EP | 0 613 196 A | 8/1994 |
| EP | 1 138 493 A | 10/2001 |
| EP | 1 138 493 A1 | 10/2001 |
| EP | 1 316 426 A | 6/2003 |
| JP | A 05-330067 | 12/1993 |
| JP | A 2001-328260 | 11/2001 |
| JP | A 2002-096477 | 4/2002 |
| JP | A-2004-358872 | 12/2004 |

* cited by examiner

*Primary Examiner*—Stephen Meier
*Assistant Examiner*—Lisa M. Solomon
(74) *Attorney, Agent, or Firm*—Oliff & Berridge, PLC

(57) ABSTRACT

In an ink-jet head including a discharge element group in which discharge elements each including a nozzle for discharging ink and a pressure chamber for applying a discharge pressure to the ink supplied from a manifold are disposed at specified intervals, a manifold and plural discharge elements are formed of through holes provided in plural thin plates bonded with adhesive and laminated, and plural dummy paths positioned around the discharge element group are formed of opening parts provided to communicate with each other in the plural thin plates.

10 Claims, 6 Drawing Sheets

INK-JET HEAD

BACKGROUND OF THE INVENTION

1. Field of the Invention

The present invention relates to an ink-jet head provided in a printer or the like, and particularly to an ink-jet head including a discharge element group in which plural discharge elements for discharging ink are disposed.

2. Description of the Related Art

An ink-jet head used for a printer, a facsimile or the like is formed of plural thin plates which are bonded with adhesive and are laminated. Through holes are provided in each of the thin plates, and by the through holes, a discharge element group is formed in which plural discharge elements having ink flow paths are disposed.

Each of the discharge elements includes a nozzle for discharging ink, and a pressure chamber communicates with the nozzle. A manifold for supplying ink is provided to communicate with the pressure chamber. An aperture for restricting the flow amount of ink is formed between the manifold and the pressure chamber. An actuator such as a piezoelectric element is fixed to the pressure chamber, and ink is pressurized and is sent from the pressure chamber by driving of the actuator. By this, a predetermined amount of ink is discharged from each nozzle.

According to the ink-jet head having the above structure, when the respective layers are bonded to each other, adhesive applied to the periphery of the discharge element group flows into the ink flow path of the discharge element disposed at the outer periphery of the discharge element group. Thus, there has been a problem that the ink flow path is blocked by the adhesive, and the discharge accuracy of the ink-jet head is lowered.

Japanese Patent Application No. 2002-280581 discloses an ink-jet head in which an opening part is provided around a pressure chamber. By this, adhesive applied to the periphery of a discharge element group flows into the opening part, and it is possible to prevent the pressure chamber from being blocked.

However, in the ink-jet head disclosed in Japanese Patent Application No. 2002-280581, when the amount of adhesive pushed out from the outside of the discharge element group toward the inside by lamination becomes large, there has been a fear that the adhesive overpasses the opening part and flows into the through hole forming the pressure chamber.

Besides, even if the flow of the adhesive into the pressure chamber is prevented, there has also been a problem that the adhesive flows into a through hole of another layer forming the ink flow path and the ink flow path is blocked. Especially, since an aperture for narrowing a flow path is required to be formed such that its cross-sectional area is small, an aperture plate itself forming the aperture is thin, and the volume of an opening part formed therein must be small. Thus, in the aperture of the discharge element disposed at the outer periphery of the discharge element group, even if the opening part is provided therearound, the adhesive is apt to flow in.

SUMMARY OF THE INVENTION

It is an object of the invention to provide an ink-jet head which prevents an ink flow path from being blocked and can improve discharge accuracy.

In order to achieve the above object, according to one aspect of the invention, an ink-jet head including: a discharge element group having discharge elements disposed at specified intervals, each of the discharge elements including; a nozzle which discharges ink; and a pressure chamber which applies a discharge pressure to the ink supplied from a manifold; wherein the manifold and the plural discharge elements are configured by plural plates including at least one opening part which are bonded with adhesive and laminated, plural dummy paths are formed by the at least one opening part of the laminated plural plates to communicate with each other, and the plural dummy paths are positioned around the discharge element group.

According to this structure, the thin plates provided with the through holes are laminated via the adhesive, and the through holes communicate with each other so that the discharge elements each including the nozzle and the pressure chamber and the manifold are formed. The opening parts communicating with each other in the plural layers are formed around the discharge element group in which the discharge elements are disposed at the specified intervals. Part of the adhesive applied to the periphery of the discharge element group is pushed out toward the discharge element group from the outside of the discharge element group by lamination, and flows into the dummy paths formed of the opening parts. Each of the dummy paths is formed of the opening part not communicating with the manifold and the opening part communicating with the manifold and not communicating with the nozzle, and does not play a role in the discharge of the ink. Incidentally, the opening part may be a through part, or may be an opening which is formed by half-etching or the like and one surface of which is closed.

According to another aspect of the invention, communication with the manifold is blocked in the dummy paths.

According to this structure, the flow of ink from the manifold into the dummy paths is prevented.

According to another aspect of the invention, the plural plates include; a nozzle layer which forms the nozzle; a pressure chamber layer which forms the pressure chamber; a manifold layer which forms the manifold; and an aperture layer disposed between the manifold layer and the pressure chamber layer which is provided with an aperture which sends the ink from the manifold to the pressure chamber, and each of the dummy paths includes the opening part formed in the aperture layer to have a same shape as the aperture.

According to this structure, the dummy path is formed to include the opening part formed in the aperture layer to have the same shape. Accordingly, since the adhesive possibly flowing into the aperture of the aperture layer flows into the opening part formed in the aperture layer, the flow of the adhesive into the aperture can be avoided to the utmost.

According to another aspect of the invention, the manifold layer includes the through hole which forms a communicating hole communicating the pressure chamber with the nozzle, and each of the dummy paths includes the opening part formed to have a same shape as the through hole of the manifold layer and constitutes the communicating hole.

According to this structure, the dummy path is formed to include the opening part formed to have the same shape as the through hole for constituting the communicating hole communicating the pressure chamber formed in the manifold layer with the nozzle. Accordingly, since the adhesive possibly flowing into the communicating hole formed in the manifold layer flows into the opening part formed in the manifold layer, the flow of the adhesive into the communicating hole can be avoided to the utmost.

According to another aspect of the invention, each of the opening parts forming the dummy paths is formed to have a same shape as the through hole formed in a same layer.

According to this structure, the opening part forming the dummy path is formed to have the same shape as the through hole formed in the same layer. Accordingly, the opening part constituting the dummy path, together with the through hole formed in the same layer, can be easily formed.

According to another aspect of the invention, the dummy paths, together with the plural discharge elements constituting the discharge element group, are disposed at the specified intervals.

According to this structure, the dummy paths, together with the plural discharge elements constituting the discharge element group, are disposed at the specified intervals. Accordingly, the dummy paths, together with the discharge elements, can be easily formed.

According to another aspect of the invention, the opening parts are formed as through holes passing through the layers in which they are formed, and the dummy paths are formed as communicating holes in which the through holes communicate with each other.

According to another aspect of the invention, the nozzles and the pressure chambers are disposed in a matrix form to constitute the discharge element group.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

Hereinafter, embodiments of the invention will be described with reference to the drawings.

Figure 1:
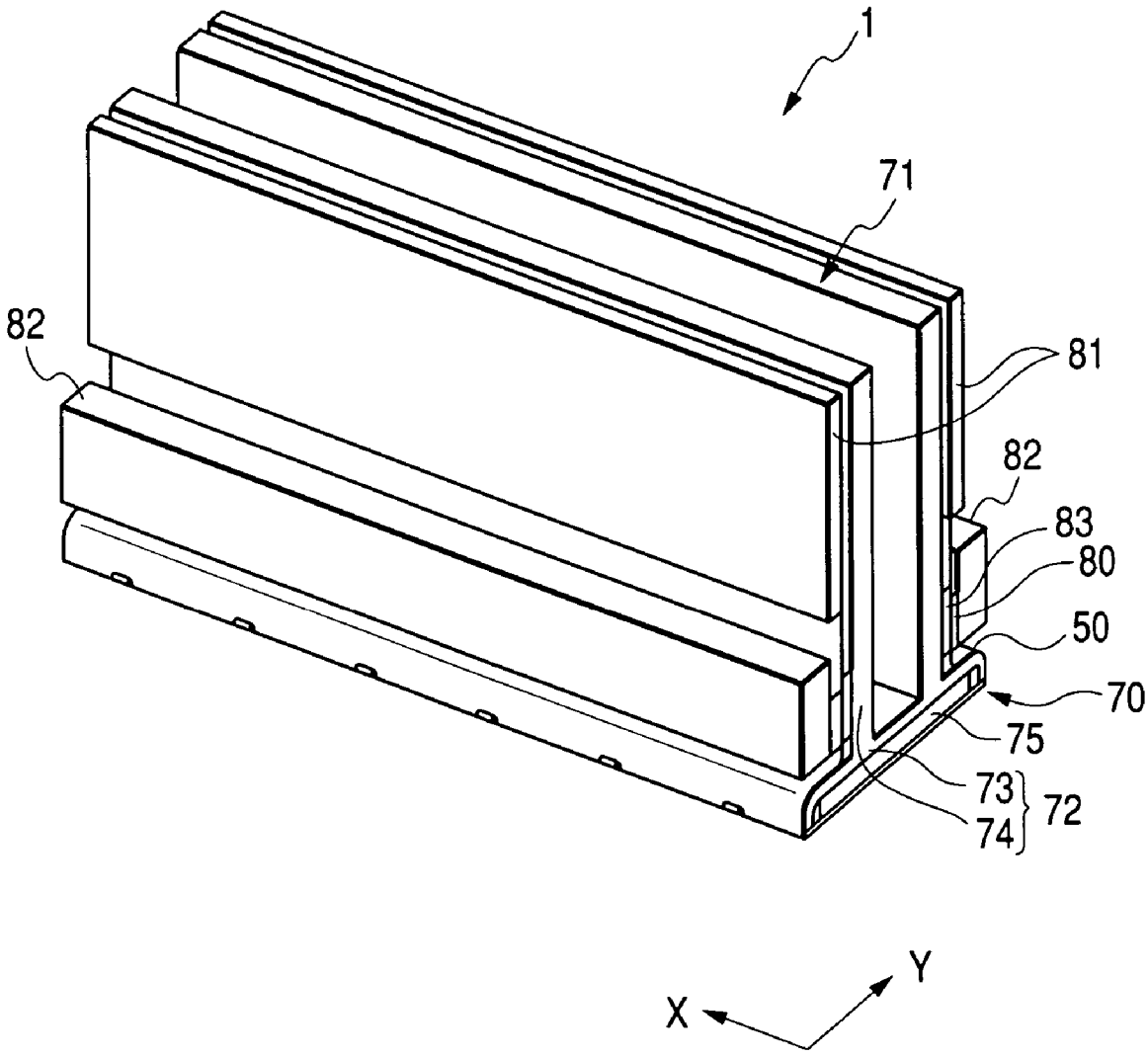
FIG. 1 is a perspective view of an ink-jet head of an embodiment of the invention.

FIG. 1 is a perspective view showing an ink-jet head of an embodiment. In an ink-jet head 1, a head unit 70 disposed to be opposite to a recording sheet is held by a base part 71. The ink-jet head 1 is scanned in an X direction (main scanning direction), and the recording sheet is transported in a Y direction (sub-scanning direction), so that recording can be performed on the recording sheet.

The head unit 70 includes a flow path unit 2 in which a flow path including a pressure chamber 10, a nozzle 8 and the like is constructed, and an actuator unit 4 for pressurizing ink in the pressure chamber 10 (see FIGS. 2 and 4), and discharges the ink to a specified position of the recording sheet. The base part 71 includes a base block 75 and a holder 72. The base block 75 is fixed to the back side of the head unit 70, and supports the head unit 70 formed to be thin and reinforces its strength.

The holder 72 includes a main body part 73 and a support part 74. The main body part 73 holds base block 75. The support part 74 is provided to extend from the main body part 73 in the opposite direction to the head unit 70, and the ink-jet head 1 is supported by the support part 74.

An FPC 50 connected to an individual electrode 6 (see FIG. 5) forming an actuator is disposed on the outer periphery of the base part 71 through an elastic member 83 such as a sponge. A driver IC 80 for driving the actuator and a control board 81 for controlling the driver IC 80 are attached to the FPC 50. A heat sink 82 for dissipating heat generation is fixed to the driver IC 80.

Figure 2:
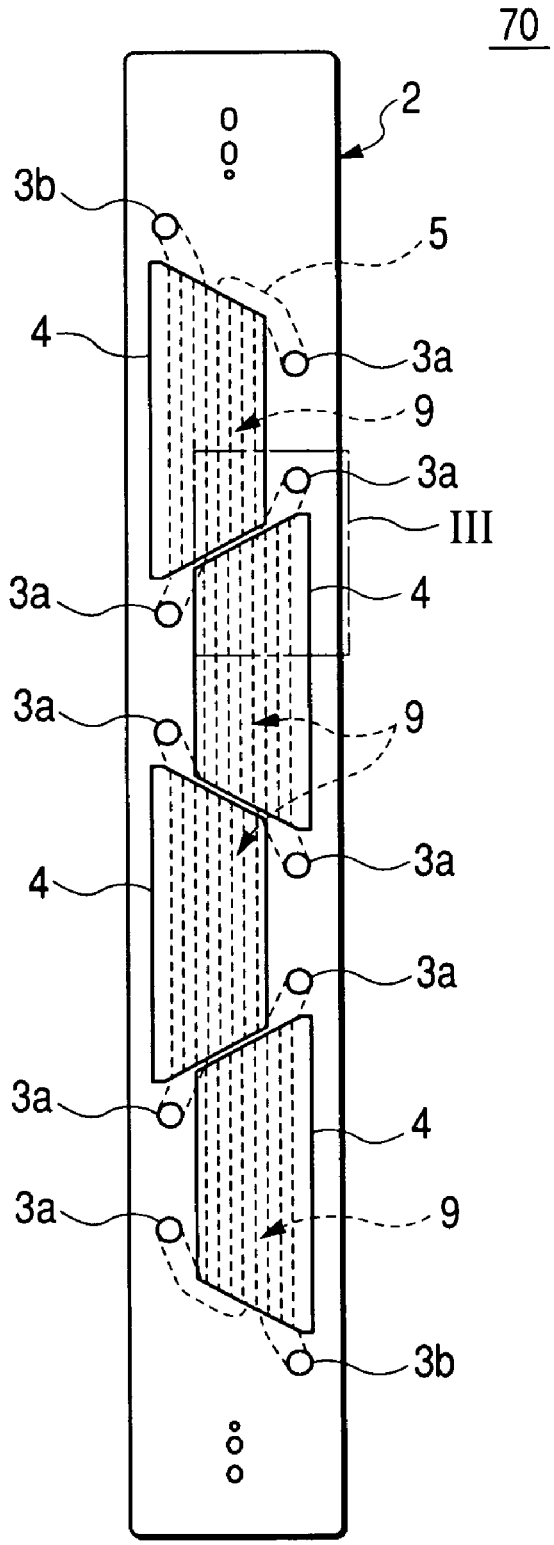
FIG. 2 is a plan view of a head unit of the ink-jet head of the embodiment of the invention.

FIG. 2 is a plan view showing the head unit 70. The head unit 70 includes the flow path unit 2 for forming the ink flow path. The flow path unit 2 is formed to be rectangular, and includes plural discharge element groups 9 disposed in two lines side by side in a long side direction, while they are overlapped in a short side direction.

The actuator unit 4 including the actuators made of piezoelectric elements is fixed onto each of the discharge element groups 9. Besides, ink is supplied to each of the discharge element groups 9 from a manifold 5 communicating with an ink pool (not shown) provided in the base block 75 (see FIG. 1) through an opening part 3*a*, 3*b*.

Figure 3:
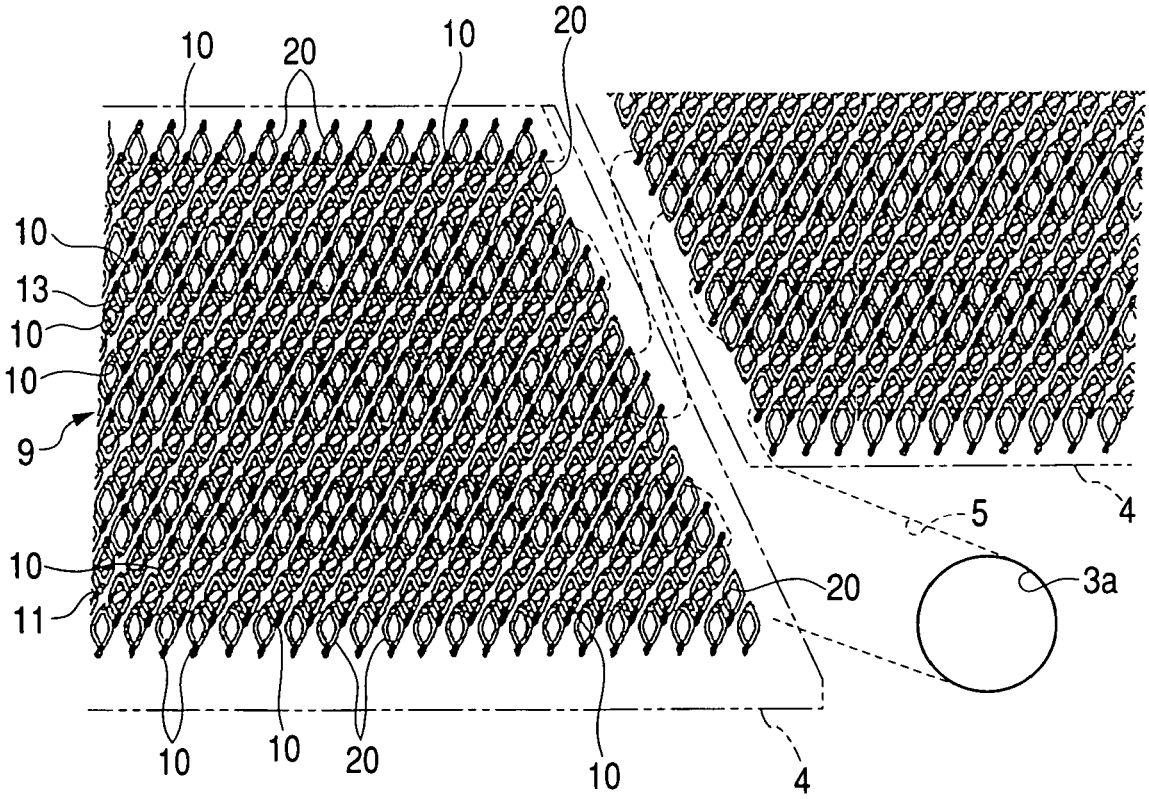
FIG. 3 is a detailed view of a part III of FIG. 2.

FIG. 3 is a plan view showing the details of a part III of FIG. 2. Each of the discharge element groups 9 is configured by many discharge elements 11 discharging ink which are disposed in a matrix form correspondingly to respective pixels of a recording image, and its outer shape is substantially trapezoidal. Each of the discharge elements 11 includes an aperture 13 communicating with the manifold 5, a pressure chamber 10, a nozzle 8 (see FIG. 4) and the like. Besides, dummy paths 20 disposed at the same period as the discharge elements 11 are formed at the whole of the periphery of each of the discharge element groups 9.

Figure 4:
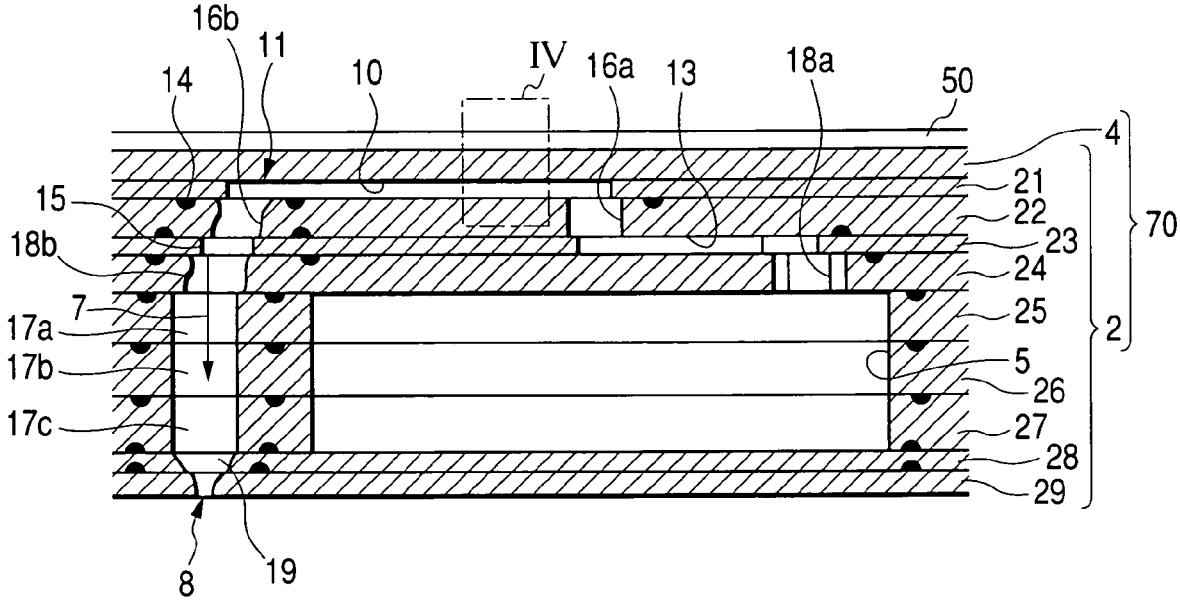
FIG. 4 is a sectional view showing a discharge element of the ink-jet head of the embodiment of the invention.

FIG. 4 shows a sectional shape of the discharge element 11. The flow path unit 2 is constructed by laminating thin plates of Ni or the like. A cavity plate 21, a base plate 22, an aperture plate 23, a supply plate 24, manifold plates 25, 26, and 27, a cover plate 28, and a nozzle plate 29 are provided in sequence from the side of the actuator unit 4.

The pressure chamber 10 is formed in the cavity plate 21. The pressure chamber 10 pressure-feeds the ink sucked from the manifold 5 to the nozzle 8 by driving of the aftermentioned actuator. The aperture 13 and a through hole 15 constituting an ink delivery path 7 are formed in the aperture plate 23. The flow path of the ink flowing into the pressure chamber 10 from the manifold 5 is narrowed by the aperture 13. A through hole 16*a* for communicating the aperture 13 with the pressure chamber 10 and a through hole 16*b* constituting the ink delivery path 7 are formed in the base plate 22.

The manifold plates 25, 26 and 27 are laminated to form the manifold 5, and through holes 17*a*, 17*b* and 17*c* constituting the ink delivery path 7 are formed. A through hole 18*a* for communicating the aperture 13 with the manifold 5 and a through hole 18*b* constituting the ink delivery path 7 are formed in the supply plate 24.

The nozzle 8 for discharging the ink sent through the ink delivery path 7 is formed in the nozzle plate 29. An opening part 19 constituting the ink delivery path 7 and for supplying the ink to the nozzle 8 is formed in the cover plate 28. Incidentally, reference numeral 14 designates a groove which releases adhesive for bonding the respective layers.

Figure 5:
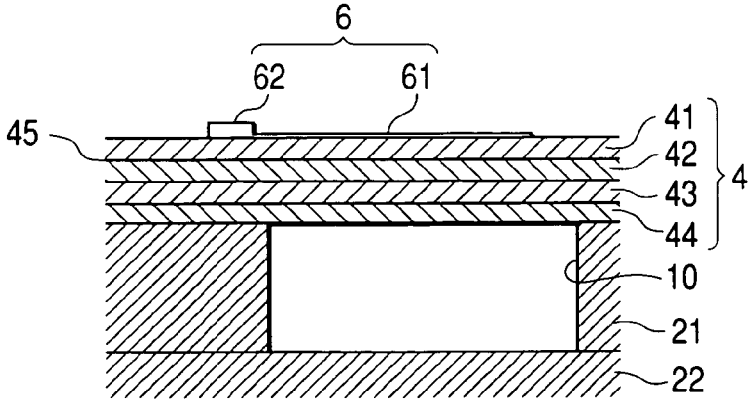
FIG. 5 is a sectional view showing an actuator unit of the ink-jet head of the embodiment of the invention.

FIG. 5 shows a part IV of FIG. 4, and is a sectional view showing the details of the actuator unit 4. In the actuator unit 4, plural piezoelectric sheets 41 to 44 are laminated through an internal electrode 45. At the side away from the flow path unit 2 side, the individual electrode 6 corresponding to each of the discharge elements 10 is provided.

Figure 6:
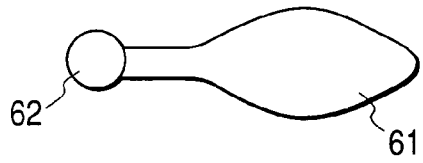
FIG. 6 is a plan view showing an individual electrode of the actuator unit of the ink-jet head of the embodiment of the invention.

As shown in FIG. 6, the individual electrode 6 includes a land part 62 and an electrode part 61, and the electrode part 61 is formed to have a plain shape approximate to that of the pressure chamber 10. By this, the actuator formed of the piezoelectric element corresponding to each of the discharge elements 11 is constructed, and when voltage is applied to the individual electrode 6, the volume of the pressure chamber 10 (see FIG. 4) is changed, and the suction and pressure feed of ink is enabled.

Figure 7:
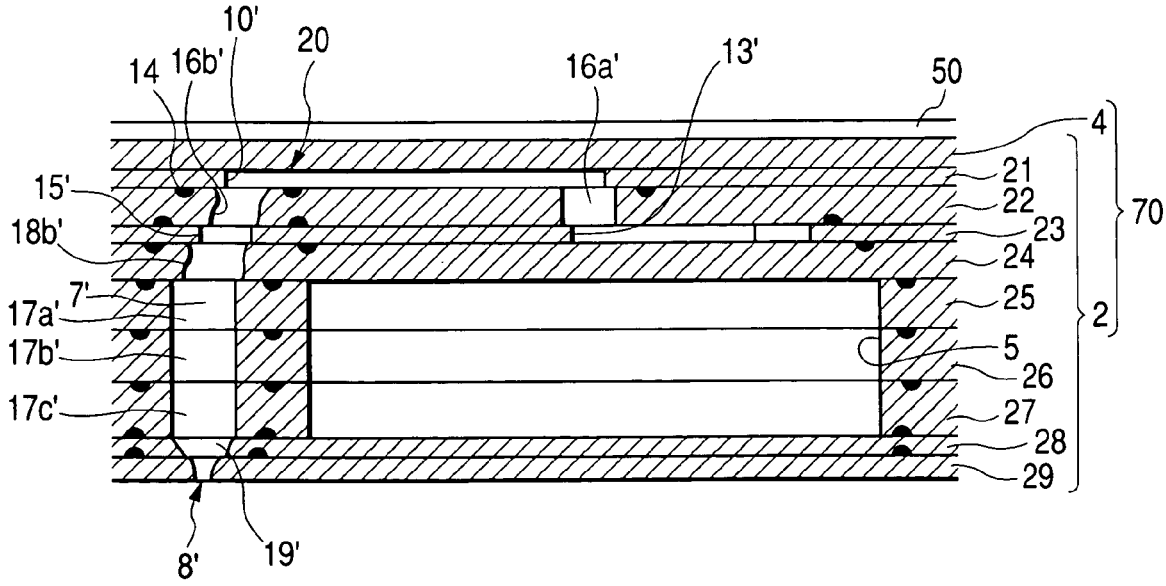
FIG. 7 is a sectional view showing a dummy path of the ink-jet head of the embodiment of the invention.

FIG. 7 shows a sectional shape of the dummy path 20. The dummy path 20 is constituted by opening parts formed in the respective laminated thin plates, and is formed to have a shape similar to the discharge element 11 (see FIG. 4). An opening part 10' having the same shape as the pressure chamber 10 is formed in the cavity plate 21.

An opening part 13' having the same shape as the aperture 13 and an opening part 15' having the same shape as the through hole 15 constituting the ink delivery path 7 are formed in the aperture plate 23. Opening parts 16*a*' and 16*b*' are formed in the base plate 22. The opening part 16*b*' has the same shape as the through hole 16*b* forming the ink delivery path 7. The opening part 16*a*' has the same shape as the through hole 16*a* communicating the aperture 13 with the pressure chamber 10.

An opening part 18*b*' having the same shape as the through hole 18*b* is formed in the supply plate 24. Opening parts 17*a*', 17*b*' and 17*c*' having the same shape as the through holes 17*a*, 17*b* and 17*c* forming the ink flow path are formed in the manifold plates 25, 26 and 27. The opening parts 17*a*', 17*b*' and 17*c*' constitute a communicating hole 7' having the same shape as the ink delivery path 7. An opening part 19' having the same shape as the through hole 19 is formed in the cover plate 28. An opening part 8' having the same shape as the nozzle 8 is formed in the nozzle plate 29.

Besides, a hole for communicating the opening part 13' with the manifold 5 is not provided in the supply plate 24, and the communication between the dummy path 20 and the manifold 5 is blocked. By this, ink is not discharged from the opening part 8', and a change in quality of ink due to its retention in the dummy path 20 can be prevented. Besides, part of the dummy path 20 and the manifold 5 are communicated with each other and the discharge of ink may be stopped without providing an opening part (for example, the opening parts 8' and 15') of another layer.

Figure 8:
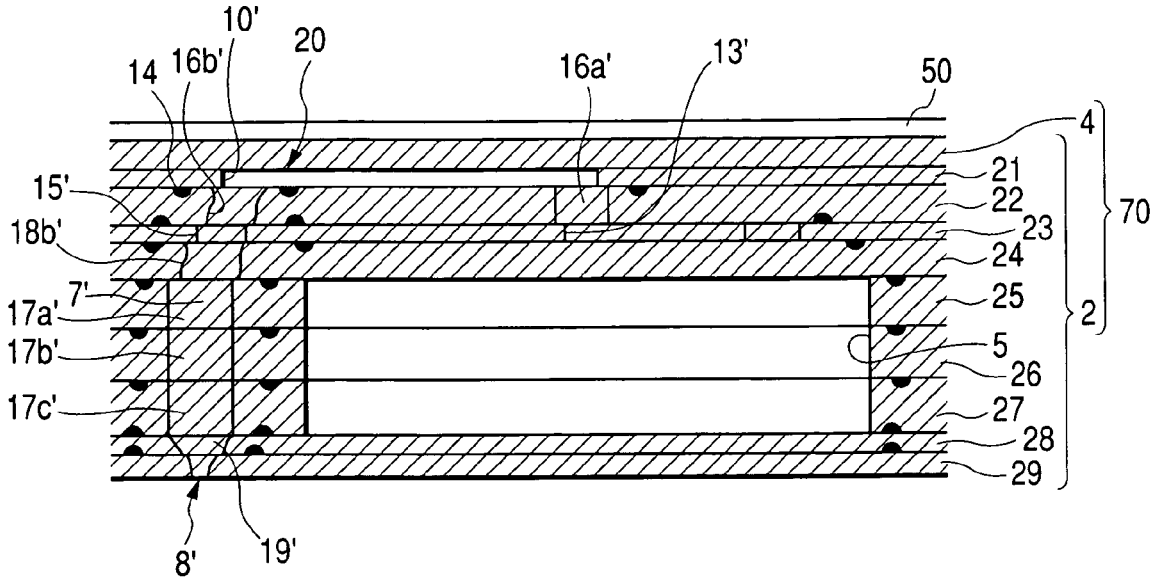
FIG. 8 is a sectional view showing a dummy path of the ink-jet head of another embodiment of the invention.

FIG. 8 is a sectional view showing a dummy path of the ink-jet head of another embodiment of the invention.

In this embodiment of FIG. 8, an opening part of each plate which forms dummy path is filled in except for an opening part 10' formed in the pressure chamber 10. Thus, opening parts 16*a*', 16*b*', the opening part 13' of the aperture plate 23, the opening part 18*b*' of the supply plate 24, the opening parts 17*a*', 17*b*' and 17*c*' of the manifold plates 25, 26, 27, the opening part 19' of the cover plate, and the opening part 8' of the nozzle plate are closed.

In the ink-jet head 1 having the above structure, when the thin plates of the respective layers are bonded through adhesive, although part of the adhesive applied to the outside of the discharge element group 9 is pushed out toward the inside of the discharge element group 9, before the adhesive reaches the discharge element group 9, it flows into the dummy path 20 provided therearound, so that the flow of the adhesive into the inside of the discharge element group 9 can be prevented.

Figure 9:
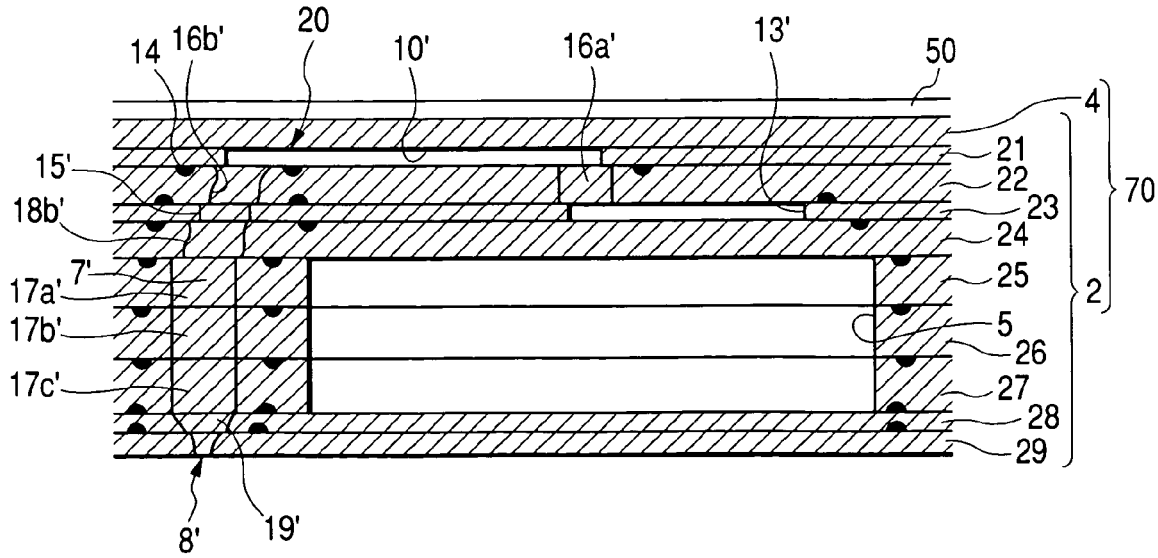
FIG. 9 is a sectional view showing a dummy path of the ink-jet head of yet another embodiment of the invention.

FIG. 9 is a sectional view showing a dummy path of the ink-jet head of yet another embodiment of the invention.

In this embodiment of FIG. 9, an opening part of each plate which forms dummy path is filled in except for the opening part 10' formed in the pressure chamber 10 and the opening part 13' of the aperture plate 23. Thus, opening parts 16*a'*, 16*b'*, the opening part 18*b*' of the supply plate 24, the opening parts 17*a'*, 17*b*' and 17*c'* of the manifold plates 25, 26, 27, the opening part 19' of the cover plate, and the opening part 8' of the nozzle plate are closed.

In the ink-jet head 1 having the above structure, when the thin plates of the respective layers are bonded through adhesive, although part of the adhesive applied to the outside of the discharge element group 9 is pushed out toward the inside of the discharge element group 9, before the adhesive reaches the discharge element group 9, it flows into the dummy path 20 provided therearound, so that the flow of the adhesive into the inside of the discharge element group 9 can be prevented.

Incidentally, as shown in FIG. 7 to FIG. 9, the foregoing opening parts are formed as holes passing through the respective plates, and the dummy path 20 is formed as the communicating hole in which the respective opening parts are communicated with each other. However, the invention is not limited to this, and each of the opening parts may be an opening which is formed by half-etching and one surface of which is closed.

In the ink-jet head 1 having the above structure, when the thin plates of the respective layers are bonded through adhesive, although part of the adhesive applied to the outside of the discharge element group 9 is pushed out toward the inside of the discharge element group 9, before the adhesive reaches the discharge element group 9, it flows into the dummy path 20 provided therearound, so that the flow of the adhesive into the inside of the discharge element group 9 can be prevented.

At this time, since the dummy path 20 is constituted by the opening parts communicating with each other in the plural layers, even if the amount of adhesive becomes large, it flows also into the opening part of the lower layer or the upper layer, and the flow into the discharge element group 9 can be prevented. For example, even if a large amount of adhesive flows into the opening part 10' at the position corresponding to the pressure chamber 10, it can be held by the opening parts 16*a*' and 16*b*' formed in the base plate 22 of the lower layer.

Besides, in the aperture 13 narrowing the flow path from the manifold 5 and for sending ink to the pressure chamber 10, the thickness of the aperture plate 23 is formed to be thin in order to decrease the cross-sectional area. Thus, even in the case where the adhesive for bonding the aperture plate 23 can not be held by only the opening part 13' corresponding to the aperture 13 and the opening part 15', it can be held by the opening parts 16*a*', 16*b*' and 18*b*' provided in the base plate 22 of the upper layer and the supply plate 24 of the lower layer.

Further, since the manifold 5 is required to have a large volume in order to store ink and to supply it to the discharge element 11, it is formed to be thick by the manifold plates 25, 26 and 27. When the opening part 15' of the aperture plate 23 is formed to communicate with the opening parts 17*a*', 17*b*' and 17*c*' formed in the manifold plates 25, 26 and 27 through the opening part 18*b*' of the supply plate 24, a large amount of adhesive which can not be held by only the opening part 15' is more certainly held also by the other opening parts communicating with the opening part 15', and the flow of the adhesive into the discharge element group 9 can be prevented.

Besides, the respective opening parts (the opening parts 8', 10', etc.) forming the dummy path 20 are formed to have the same shapes as the through holes (the ink delivery path 7, the nozzle 8, the pressure chamber 10, etc.) forming the discharge element. Thus, in the respective layers of the ink-jet head 1, the periphery of the discharge element 11 disposed at the outermost periphery of the discharge element group 9 is bonded with the adhesive between the discharge element and the dummy path 20. Accordingly, since it is bonded under the same condition as the discharge element 11 disposed at an inner part of the discharge element group 9, variations in bonding state are reduced and uniform strength can be obtained.

Incidentally, in this embodiment, although the dummy path 20 is formed of the through opening parts communicating with each other in the plural layers, the opening part may be formed by half-etching or the like so that its one surface is closed. By this, for example, a through opening part is formed in a thin layer, and a half-etched opening part may be disposed in the upper layer or the lower layer of this layer. As a result, a large amount of adhesive is held and the flow of the adhesive into the inside of the discharge element group 9 can be prevented.

For example, in the aperture 13 formed in the aperture plate 23, the thickness of the aperture plate 23 itself is thin, and further, the width is also narrow to have a predetermined flow path resistance. Thus, there is also a case where in the adhesive for bonding the aperture plate 23, its flow from the outside of the discharge element group 9 into the outermost periphery can not be sufficiently prevented.

In order to more effectively prevent the inflow of an unnecessary adhesive, in addition to the opening part formed in the aperture plate 23 and provided at the position corresponding to the discharge element 11, a half-etched opening part may be provided also in the base plate 22 or the supply plate 24 laminated as the upper layer or the lower layer of the aperture plate 23 at the same position as the opening part of the aperture plate 23.

According to the present invention, the discharge element group is constituted by the through holes formed in the thin plates to be laminated, the dummy paths formed of the opening parts provided to communicate with each other in the plural thin plates are disposed around the discharge element group, and therefore, the adhesive pushed out toward the discharge element group from the outside of the discharge element group flows into the dummy paths, the flow of the adhesive into the inside of the discharge element group is prevented, and blockage of the ink flow path can be prevented. Besides, since the opening parts communicate with each other in the plural layers, even if the amount of adhesive becomes large, the adhesive flows also into the opening part of the lower layer or the upper layer and the flow into the discharge element group can be prevented.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents

What is claimed is:

1. An ink-jet head comprising:

a discharge element group having discharge elements disposed at specified intervals, each of the discharge elements including;

a nozzle which discharges ink; and a pressure chamber which applies a discharge pressure to the ink supplied from a manifold; wherein the manifold and the plural discharge elements are configured by plural plates each including at least one opening part, the plural plates being bonded with adhesive and laminated, plural dummy paths are formed by the opening parts of the laminated plural plates, which communicate with each other, and the plural dummy paths are positioned around the discharge element group.

2. The ink-jet head according to claim 1, wherein communication with the manifold is blocked in the dummy paths.

3. The ink-jet head according to claim 2, wherein the plural plates include;

a nozzle layer which forms the nozzle;

a pressure chamber layer which forms the pressure chamber;

a manifold layer which forms the manifold; and an aperture layer disposed between the manifold layer and the pressure chamber layer and provided with an aperture which sends the ink from the manifold to the pressure chamber, and each of the dummy paths includes the opening part formed in the aperture layer to have a same shape as the aperture.

4. The ink-jet head according to claim 1, wherein the plural plates include;

a nozzle layer which forms the nozzle;

a pressure chamber layer which forms the pressure chamber;

a manifold layer which forms the manifold; and an aperture layer disposed between the manifold layer and the pressure chamber layer and provided with an aperture which sends the ink from the manifold to the pressure chamber, and each of the dummy paths includes the opening part formed in the aperture layer to have a same shape as the aperture.

5. The ink-jet head according to claim 4, wherein the manifold layer includes the through hole which forms a communicating hole communicating the pressure chamber with the nozzle, and each of the dummy paths includes the opening part formed to have a same shape as the through hole of the manifold layer and constitutes the communicating hole.

6. The ink-jet head according to claim 1, wherein each of the opening parts forming the dummy paths is formed to have a same shape as the through hole formed in a same layer.

7. The ink-jet head according to claim 1, wherein the dummy paths, together with the plural discharge elements constituting the discharge element group, are disposed at the specified intervals.

8. The ink-jet head according to claim 1, wherein the opening parts are formed as through holes passing through the layers in which they are formed, and the dummy paths are formed as communicating holes in which the through holes communicate with each other.

9. The ink-jet head according to claim 1, wherein the nozzles and the pressure chambers are disposed in a matrix form to constitute the discharge element group.

10. The ink-jet head according to claim 1, wherein the plural plates further includes at least one groove which releases the adhesive.

* * * * *